United States Patent [19]

Steadman

[11] Patent Number: 4,729,074

[45] Date of Patent: Mar. 1, 1988

[54] CEILING FRAME FOR A LIGHTING FIXTURE

[76] Inventor: Earl J. Steadman, P.O. Box 13, Toledo, Ohio 43692

[21] Appl. No.: 940,570

[22] Filed: Dec. 11, 1986

[51] Int. Cl.[4] ..... F21S 1/02

[52] U.S. Cl. ..... 362/148; 248/343; 52/28

[58] Field of Search ..... 362/148, 149, 150, 343, 362/365; 248/342, 343, 27.1; 52/28, 474, 482, 484, 664; 49/463

[56] References Cited

U.S. PATENT DOCUMENTS

| | | | |
|---|---|---|---|
| 2,717,955 | 9/1955 | Schwemmer et al. | 362/148 |
| 2,767,307 | 10/1956 | McGinty et al. | 362/365 |
| 2,898,074 | 8/1959 | Versen | 248/343 |
| 2,898,075 | 8/1959 | McGinty | 248/343 |
| 2,962,582 | 11/1960 | Croft | 362/149 |
| 4,188,656 | 2/1980 | Howard | 362/365 |
| 4,431,151 | 2/1984 | Schonasky | 248/342 |

*Primary Examiner*—Samuel Scott
*Assistant Examiner*—Noah Kamen
*Attorney, Agent, or Firm*—Allen D. Gutchess, Jr.

[57] ABSTRACT

A ceiling frame is provided for a lighting fixture. The ceiling is of the type made of plaster panels commonly known as dry wall, wallboard, plaster board, or gypsum board. A rectangular opening is made in the plaster panels between rafters and the lighting fixture is suitably mounted on the ceiling above the panels. The ceiling frame includes side frame members having vertical flanges positioned adjacent the edges of the ceiling panels at the rectangular opening and horizontal flanges extending outwardly from the opening along the lower surfaces of the panels. The horizontal flanges are affixed to the panels by pop rivets or the like which also extend through upper horizontal flanges or brackets adjacent the upper surfaces of the panels. The ceiling frame also includes two end frame members of similar design but affixed to the ceiling panels adjacent the end edges of the opening by rivets and brackets. When the frame members are in place, joint compound is spread over them and feathered outwardly to the ceiling surface to provide a smooth, rimless frame for the light fixture.

20 Claims, 6 Drawing Figures

CEILING FRAME FOR A LIGHTING FIXTURE

BACKGROUND OF THE INVENTION

This invention relates to a frame for a lighting fixture and specifically for a recessed lighting fixture mounted above an opening in a ceiling.

Numerous ceiling frames for lighting fixtures are known in the art. These frames have rims which are exposed below the ceiling surface and extend outwardly around the opening for the lighting fixture. Such lighting frame fixtures are shown, for example, in U.S. Pat. No. 2,516,660, issued July 25, 1950; U.S. Pat. No. 3,012,135, issued Dec. 5, 1961; U.S. Pat. No. 4,171,535, issued Oct. 16, 1979; U.S. Pat. No. 4,175,281, issued Nov. 20, 1979; U.S. Pat. No. 4,293,895, issued Oct. 6, 1981; U.S. Pat. No. 4,419,717, issued Dec. 6, 1983; U.S. Pat. No. 4,450,512, issued May 22, 1984; and U.S. Pat. No. 4,459,648, issued July 10, 1984.

SUMMARY OF THE INVENTION

The present invention provides a rimless, ceiling frame for a lighting fixture, with the ceiling surface extending in an unbroken manner to the edges of a rectangular lighting fixture opening in the ceiling. The ceiling frame comprises four frame members, two of which extend along side or longitudinal edges of the lighting fixture opening and two of which extend along end or transverse edges of the lighting fixture opening. Each of the side and end frame members has a vertical flange which has a width about equal to the thickness of the ceiling panels. A horizontal flange extends outwardly from the lower edge of the vertical flange along the lower surface of the ceiling panel. The horizontal flange has openings spaced therealong to receive pop rivets or other fasteners which are inserted through the flange openings, through the ceiling panel, and through another horizontal flange or bracket located at the upper surface of the ceiling panels. The lower horizontal flanges have additional openings and dimples which receive joint compound which is spread over the lower horizontal flanges and feathered outwardly therebeyond to provide a smooth ceiling surface up to the edge of the lighting fixture opening.

The ceiling frame can be made of four separate frame members or of a one-piece construction. The frame members can also have inwardly-extending flanges to receive a light-transmitting panel. Wooden strips or similar elements can be placed on those flanges to support a light-transmitting panel, such as an egg-crate type, when it is desired to have that panel recessed above the lower ceiling surface. Also, for longer, eight-foot fluorescent lighting fixtures, two light-transmitting panels can be employed, with a mullion in between.

It is, therefore, a principal object of the invention to provide a rimless ceiling frame for a recessed lighting fixture as described above.

BRIEF DESCRIPTION OF THE DRAWINGS

Other objects and advantages of the invention will be apparent from the following detailed description of preferred embodiments thereof, reference being made to the accompanying drawings, in which.

DESCRIPTION OF THE PREFERRED EMBODIMENTS

Figure 1:
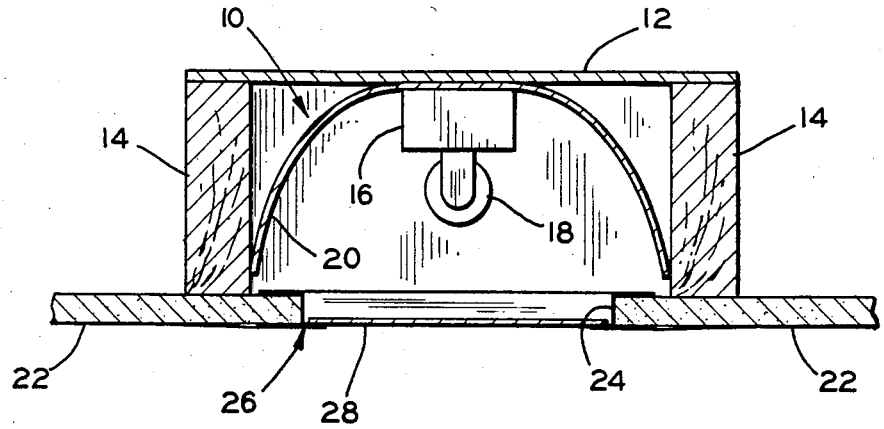
FIG. 1 is a somewhat schematic view in vertical cross section taken through a ceiling structure, lighting fixture, ceiling panels, and lighting fixture frame in accordance with the invention.

Referring to FIG. 1, a lighting fixture indicated at 10 is mounted below boards 12 and between ceiling rafters 14. The lighting fixture 10 includes an electrical base 16, a fluorescent tube 18, and a suitable reflector 20. Ceiling panels 22 are affixed in coplanar relationship to the lower edges of the rafters 14 and are of plaster. The ceiling panels 22 are of the type commonly known as dry wall, wallboard, plaster board, or gypsum board. A rectangular opening 24 is made in the ceiling panels 22 with the dimensions of this opening typically being $12\frac{1}{4}'' \times 48\frac{1}{4}''$ for a four-foot fluorescent light. After the opening is formed, the edges of the plaster panels are coated with joint compound to prevent the possibility of flaking of the plaster composition. A ceiling frame 26 is subsequently installed at the edges of the opening 24 and supports a light-transmitting panel 28.

Figure 2:
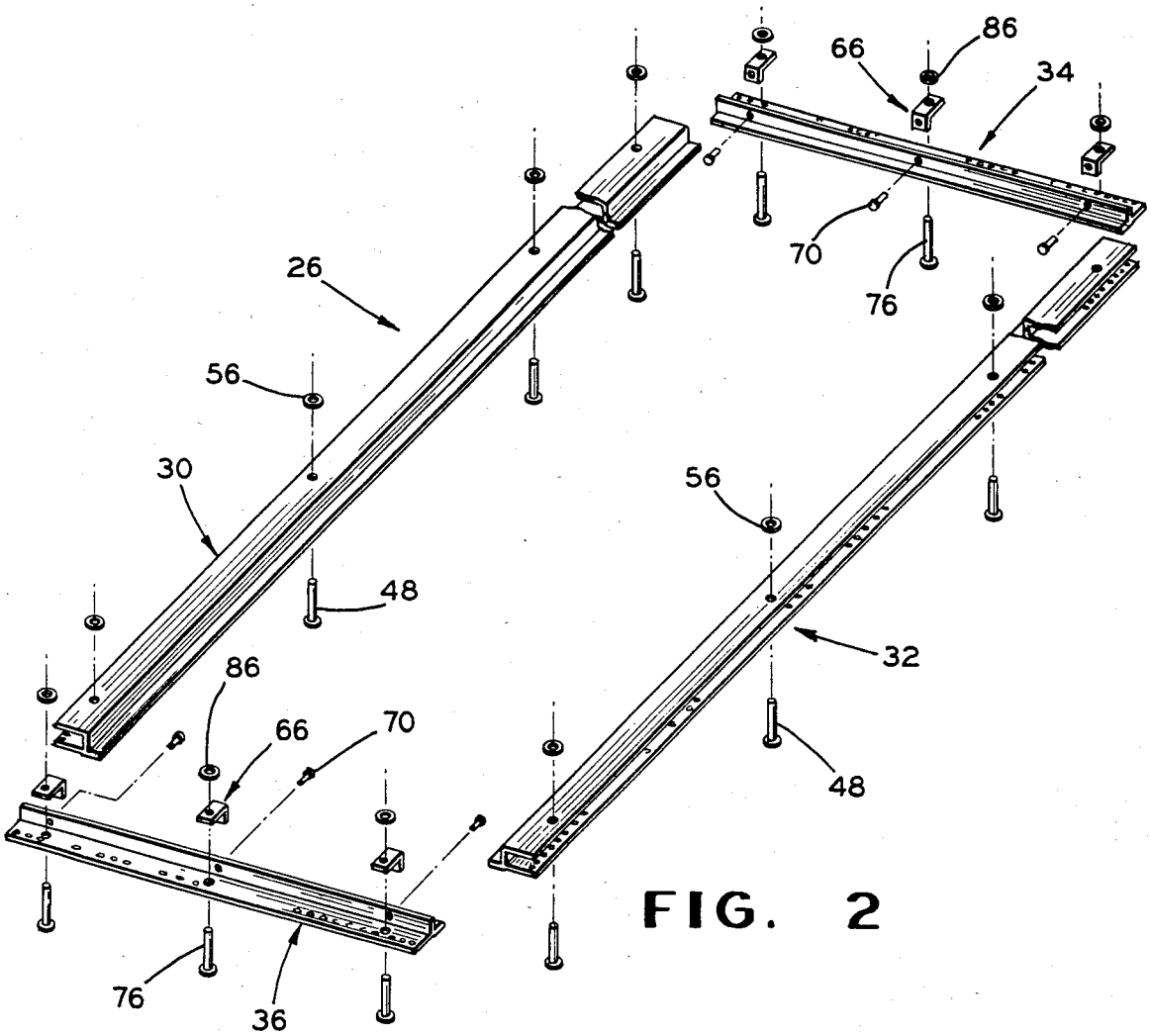
FIG. 2 is a somewhat schematic, exploded, fragmentary view in perspective of the lighting fixture frame.
Figure 3:
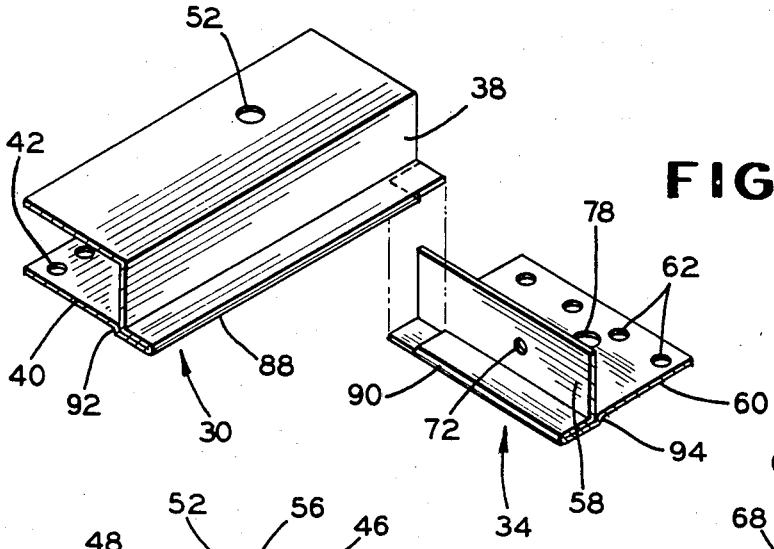
FIG. 3 is a fragmentary, enlarged, exploded view in perspective of end portions of two frame members of the frame of FIG. 2.
Figure 4:
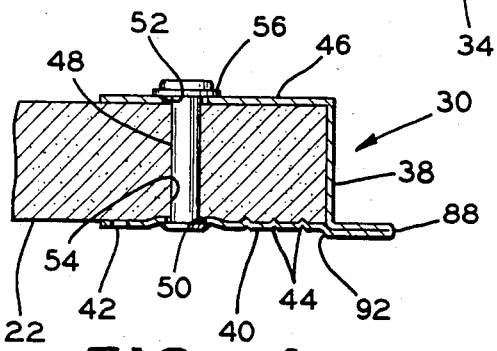
FIG. 4 is a fragmentary, further enlarged view in transverse cross section taken through a side frame member of the frame of FIG. 2.

Referring particularly to FIGS. 2–4, the ceiling frame 26 includes longitudinal or side frame members 30 and 32 and transverse or end frame members 34 and 36. Each of the side frame members 30 and 32 includes a vertical flange 38 extending the length of the opening 24 and having a width substantially equal to the thickness of the ceiling panels 22, one-half inch being typical of that thickness. A thin, lower horizontal flange 40 extends outwardly from the lower edge of the flange 38, away from the opening 24, this flange being about one inch wide. The horizontal flange 40 has a multiplicity of openings 42 therealong near an outer edge thereof receiving joint compound which aids in holding the flange 40 adjacent the lower surface of the ceiling panels 22, when hardened. The lower surface of the flange 40 also has dimples 44 therein to increase the surface of the area and increase the bond with the joint compound.

The side frame members also have upper plate means in the form of horizontal flanges 46 which extend the length of the opening 24 and have a width about equal to the width of the lower flanges 40. Commercially-available pop rivets or other suitable fasteners 48 are assembled with the side frame members after they have been inserted in place over the side edges of the panels 22 at the opening 24. The pop rivets 48 are inserted through holes 50 and 52 preformed in the flanges 40 and 45 and through bores or holes 54 drilled in the ceiling panels 22. The upper ends of the pop rivets 48 are also received in washers 56 an the upper surfaces of the horizontal flanges 46.

Each of the end frame members 34 and 36 had a vertical flange 58 which extends the length of the ends of the opening 24 and has a width substantially equal to the thickness of the ceiling panels 22. The end frame member also has a horizontally-extending flange 60 which extends outwardly from the lower edge of the flange 58 about the same distance as the horizontal flanges 40. The horizontal flange 60 has openings 62 near the outer edge thereof and dimples 64 for the same purposes as in the flanges 40.

The end frame members 34 and 36 are installed after the side frame members 30 and 32 are in place. These are installed vertically into place with L-shaped brackets 66 positioned on the upper surfaces of the ceiling panels 22 and adjacent the edges thereof at the opening 24. Vertical flanges 68 of the brackets 66 are then assembled with the vertical flanges 58 of the end frame members by suitable fasteners such as pop rivets 70 inserted through preformed holes 72 in the vertical flanges 58 and preformed holes 74 in the bracket flanges 68. The end frame members 34 and 36 are then affixed to the ceiling panels 22 by suitable fasteners such as pop rivets 76 inserted through preformed openings 78 in the lower flanges 60 and through preformed openings 80 in upper plate means in the form of horizontal flanges 82 of the brackets 66, as well as through bores or holes 84 drilled through the panels 22. Washers 86 are also located adjacent the bracket flanges 82.

In a preferred form, the side frame members 30 and 32 have short inwardly-extending flanges 88 and the end frame members 34 and 36 have similar inwardly-extending flanges 90 to support the light-transmitting panel 28. If it is desired to recess the light transmitting panel 28 above the lower surface of the ceiling panels 22, wooden strips can be placed on the inwardly-extending flanges 88 and 90 and the light-transmitting panel can be supported on the top of them. Also, a larger light-transmitting panel can be supported on the inner edges of the upper horizontal flanges 46 of the side frame members and on the brackets 66 of the end frame members if the inwardly-extending flanges 88 and 90 are not used.

Figure 5:
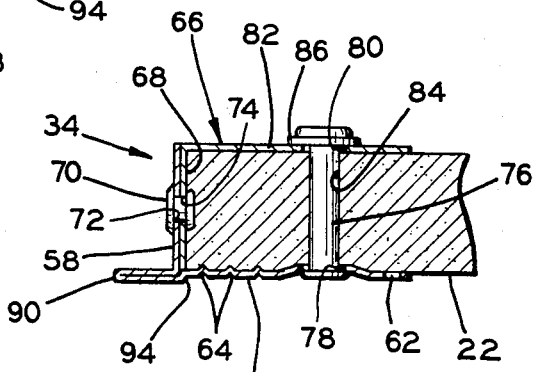
FIG. 5 is a fragmentary, enlarged view in transverse cross section taken through an end frame member of the frame of FIG. 2.

In the construction of the frame members 30-36, the flanges 88 and 90 are made of doubled-back sheet material, as shown in FIGS. 3–5. The lower layer of the sheet material at the ends on the inwardly-extending flanges 88 can then be removed. Similarly, the upper layers of the doubled-back sheet material at the ends of the flanges 90 can be similarly removed. Consequently, a smooth corner surface results when the end frame members 34 and 36 are installed. An industrial adhesive can be used at the overlapped portions of the inwardly-extending flanges 88 and 90. Also, it is possible to form a fastener on one of the end portions, which can then be received in a hole in the other of the end portions, with the fastener then flattened by pliers to hold the overlapped portions of the flanges in place.

The sheet material of which the frame members are made is also bent to form shoulders or beads 92 at the lower edges of the vertical flanges 38 of the side frame members 30 and to form similar shoulders or beads 94 at the lower edges of the vertical flanges 58 of the end frame members 34 and 36.

After all of the frame members are installed, joint compound is then spread from the shoulders 92 and 94 over the flanges 40 and 60 and feathered to a distance of about one inch beyond the outer edges of those flanges, thereby forming a smooth, continuous surface with the surfaces of the ceiling panels 22. A completely rimless lighting fixture frame is thereby achieved. No rim at all is visible from the edges of the opening 24 outwardly therefrom, in contrast to the lighting fixture frames heretofore known for ceiling lighting fixtures.

For a four-foot fluorescent tube with the opening 24 measuring about twelve inches by fourty-eight inches, typically five of the pop rivets 48 are employed along each of the side frame members 30 and 32. Three of the pop rivets 76 and the bracket 66 are employed along each of the end frame members 34 and 36. The main purpose of the fasteners 48 and 76 is to hold the outer edges of the horizontal flanges 40 and 60 in contiguous relationship with the lower surfaces of the ceiling panels 22 and overcome any tendency of the flanges 40 and 60 to buckle. The joint compount itself, applied to the flanges 40 and 60 and the adjacent areas of the ceiling panels 22, further serves to hold the frame members 30–36 in place, when hardened, with the joint compound partially flowing through the holes 42 and 62 in the outer edge portions of the flanges 40 and 60.

Figure 6:
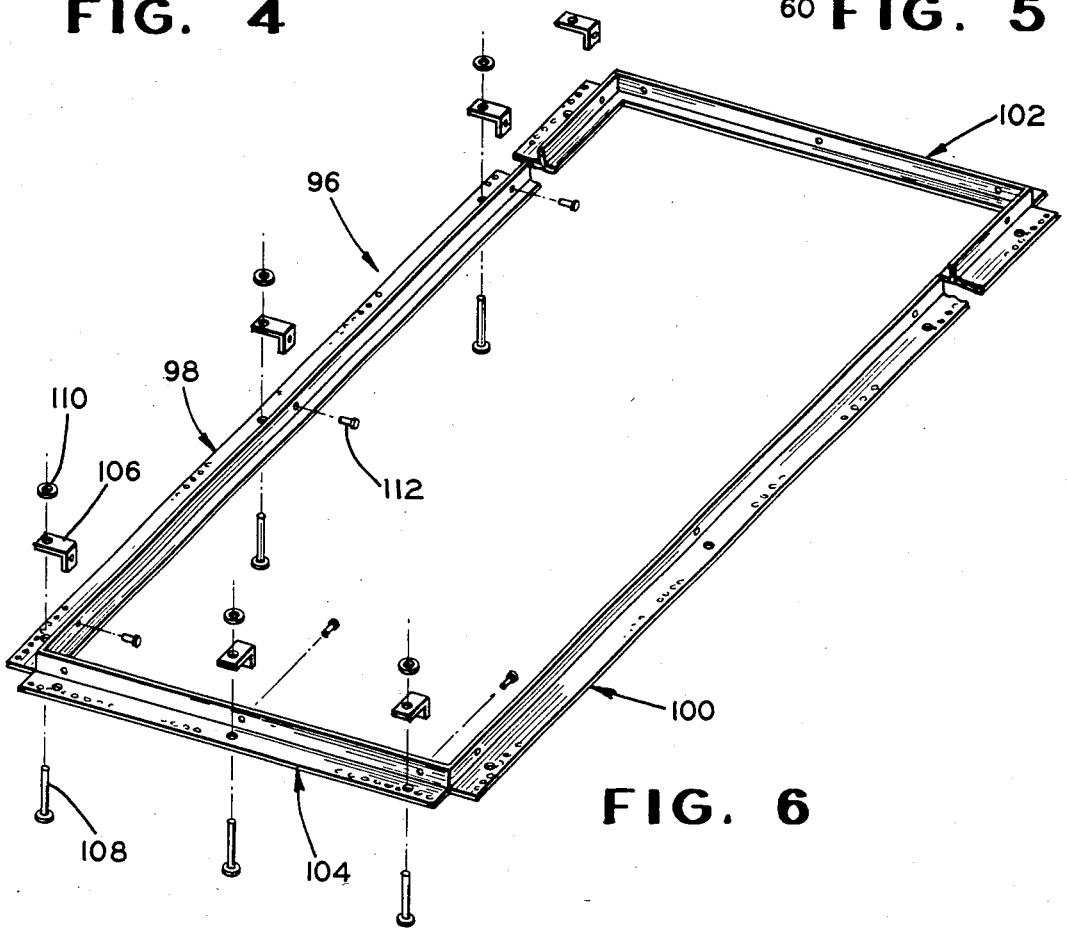
FIG. 6 is a somewhat schematic, exploded, fragmentary, view in perspective of a modified lighting fixture frame.

A one-piece ceiling frame indicated at 96 is shown in FIG. 6. In this instance, the frame is inserted vertically up into the opening 24 after it is formed. Side and end frame members 98–102 are then held in place by brackets 106 which are similar to the brackets 66, along with pop rivets or other fasteners 108 and washers 110, the brackets 106 being affixed to the frame members 98–104 by pop rivets or other suitable fasteners 112 which are similar to the pop rivets 70.

Various modifications of the above-described embodiments of the invention will be apparent to those skilled in the art and it is to be understood that such modifications can be made without departing from the scope of the invention, if they are within the spirit and the tenor of the accompanying claims.

I claim:

1. A ceiling frame for a lighting fixture, a ceiling panel being of plasterboard or the like of predetermined thickness with a rectangular opening formed therein and the lighting fixture being suitably mounted above said opening, said ceiling frame comprising two side frame members to be located along the side edges of said opening and two end frame members to be located along end edges of said openig, each of said end frame members having a first vertical flange extending substantially the length of the associated end edge of the opening and having a width about the same as the thickness of the ceiling panels, each of said end frame members further having a first wide horizontal flange at the lower edge of said vertical flange and adapted to extend out over a lower surface of the ceiling panel adjacent the associated end edge of said opening, said horizontal flange having a multiplicity of holes therein for receiving joint compound or the like for holding said horizontal flange against the lower surface of the ceiling panel, each of said side frame members having a second vertical flange extending substantially the length of the corresponding side edge of the opening and having a width about the same as the thickness of the ceiling panel, each of said side frame members further having a second wide horizontal flange structurally integral with a lower edge of said second vertical flange and adapted to extend out over the lower surface of the ceiling panel adjacent the associated side edge of said opening, said second horizontal flange having a multiplicity of holes therein for receiving joint compound or the like for holding said second horizontal flange against the lower surface of the ceiling panel, said end frame members and said side frame members having fastener openings formed therein, and fasteners extending through said fastener openings and through the ceiling panel for holding said horizontal flanges against the lower surface of the ceiling panel.

2. A ceiling frame according to claim 1 characterized by second vertical flanges having additional horizontal flanges extending in the same direction as said second horizontal flanges, said fasteners extending through holes in said additional horizontal flanges above the ceiling panels.

3. A ceiling frame according to claim 1 characterized by each of said frame members having downwardly-extending shoulders on the horizontal flanges at the lower edges of the vertical flanges to provide edges for joint compound or the like spread beyond outer edges of said horizontal flanges.

4. A ceiling frame according to claim 1 characterized by each of said vertical flanges having an inwardly-extending flange at the lower edge thereof to support a light-transmitting panel with lower edge surfaces of the light-transmitting panel lying on upper surfaces of the inwardly-extending flanges.

5. A ceiling frame according to claim 1 characterized by a plurality of L-shaped brackets for each of said end frame members, each of said brackets having a longitudinal flange and a vertical flange, said bracket vertical flange having a preformed hole therein, said bracket horizontal flange having a preformed opening therein, said vertical flanges of said end frame members having holes spaced therealong, one for each of said brackets, fasteners affixing said bracket vertical flanges to said end frame member vertical flanges, and said fasteners which are received in the fastener openings of said first horizontal flanges also extending through said openings of said bracket horizontal flanges.

6. A ceiling frame for a lighting fixture located above an opening in ceiling panels, the ceiling panels being made of plasterboard or the like or predetermined thickness with the opening being rectangular and the lighting fixture suitably mounted in the ceiling above said opening, said ceiling frame comprising two side frame members to be located along side edges of said opening and two end frame members to be located along end edges of said opening, each of said frame members having a vertical flange extending substantially the length of the associated opening edge and having a width about the same as the thickness of the ceiling panels, each of said frame members further having a wide, thin, lower horizontal flange extending outwardly at the lower edge of said vertical flange and adapted to extend out over lower surfaces of the ceiling panels adjacent the opening edges, said horizontal flanges having preformed holes therealong for receiving fasteners, and said horizontal flanges having shoulders along portions thereof adjacent lower horizontal edges of said vertical flanges to provide edges for joint compound or the like spread beyond outer edges of said horizontal flanges.

7. A ceiling frame according to claim 6 characterized by some of said vertical flanges having additional horizontal flanges at their upper edges extending in the same direction as said wide horizontal flanges.

8. A ceiling frame according to claim 6 characterized by each of said vertical flanges having plate means at upper edges thereof and adapted to extend over upper surfaces of the ceiling panels for receiving fasteners which extend through the lower horizontal flanges and the ceiling panels.

9. A ceiling frame according to claim 8 characterized by some of said plate means being second horizontal flanges extending outwardly from the vertical flanges.

10. A ceiling frame according to claim 9 characterized by other of said plate means being horizontal flanges of L-shaped brackets affixed to some of the vertical flanges.

11. A ceiling frame according to claim 8 characterized by said frame members being of one-piece construction and said plate means of all of said frame members being horizontal flanges of L-shaped brackets affixed to the vertical flanges of all of said frame members.

12. A ceiling frame according to claim 6 chracterized by each of said vertical flanges having an inwardly-extending flange at the lower edge thereof to support a light-transmitting panel with lower edge surfaces of the light-transmitting panel lying on upper surfaces of the inwardly-extending flanges.

13. A ceiling frame according to claim 12 characterized by each of said frame members being constructed on one sheet of metal with the metal being doubled back to form said inwardly-extending flanges.

14. A ceiling frame according to claim 13 characterized by end portions of one layer of the sheet metal at each end of the inwardly-extending flanges being removed whereby ends of said inwardly-extending flanges can be smoothly overlapped.

15. In combination, a ceiling comprising a plurality of plaster panels suported in co-planar relationship, said panels having a predetermined thickness, said panels having a rectangular opening formed therein of predetermined width and length, a lighting fixture located above said opening in said panels, a ceiling frame for said lighting fixture comprising two side frame members located along two side edges of said opening and two end frame members located along end edges of said opening, each of said frame members having a vertical flange extending substantially the length of the associated opening edge and having a width about the same as the thickness of the ceiling panels, each of said frame members further having a wide lower horizontal flange extending outwardly at the lower edge of said vertical flange and extending over lower surfaces of the ceiling panels adjacent the opening edges, said wide lower horizontal flanges having means to aid in affixing joint compound or the like thereto, and joint compound or the like covering said horizontal flanges and extending over adjacent portions of the lower surfaces of ceiling panels.

16. The combination according to claim 15 characterized by each of said frame members having a shoulder facing downwardly on said wide horizontal flange, said shoulder being parallel to said vertical flange, and the joint compound or the like extending to and abutting said shoulders.

17. The combination according to claim 15 characterized by each of said frame members having plate means at the upper edges of the vertical flange extending over upper surfaces of said ceiling panels, and fasteners extending through said horizontal flanges, through said ceiling panels, and through said plate means.

18. The combination according to claim 17 characterized by said plate means of said side frame members being second horizontal flanges extending outwardly from the vertical flanges of said side frame members and parallel to said lower horizontal flanges of said side frame members.

19. The combination according to claim 18 characterized by said plate means of said end frame members being horizontal flanges of L-shaped brackes affixed to said vertical flanges of said end frame members.

20. The combination according to claim 17 characterized by said plate means of all of said frame members being horizontal flanges of L-shaped brackets affixed to said vertical flanges of all of said frame members.

* * * * *

UNITED STATES PATENT AND TRADEMARK OFFICE

CERTIFICATE OF CORRECTION

PATENT NO. : 4,729,074

DATED : March 1, 1988

INVENTOR(S) : Earl J. Steadman

It is certified that error appears in the above-identified patent and that said Letters Patent is hereby corrected as shown below:

In the claims:

Claim 1, line 8, change "openig" to --opening--.

Claim 6, line 3, change "or" (second occurrence) to --of--.

Claim 19, line 3, change "brackes" to --brackets--.

Signed and Sealed this

Twelfth Day of July, 1988

*Attest:*

*Attesting Officer*

DONALD J. QUIGG

*Commissioner of Patents and Trademarks*